US009035988B2

(12) United States Patent
Nihei et al.

(10) Patent No.: US 9,035,988 B2
(45) Date of Patent: May 19, 2015

(54) LIGHT SOURCE DRIVING DEVICE, LIGHT SCANNING DEVICE AND IMAGE FORMING APPARATUS

(75) Inventors: Yasuhiro Nihei, Yokohama (JP); Masaaki Ishida, Yokohama (JP); Atsufumi Omori, Chigasaki (JP); Jun Tanabe, Sagamihara (JP)

(73) Assignee: RICOH COMPANY, LTD., Tokyo (JP)

( * ) Notice: Subject to any disclaimer, the term of this patent is extended or adjusted under 35 U.S.C. 154(b) by 1435 days.

(21) Appl. No.: 12/126,103

(22) Filed: May 23, 2008

(65) Prior Publication Data

US 2008/0291259 A1 Nov. 27, 2008

(30) Foreign Application Priority Data

May 23, 2007 (JP) ..... 2007-136653

(51) Int. Cl.
*B41J 2/435* (2006.01)
*B41J 2/47* (2006.01)

(52) U.S. Cl.
CPC ..... *B41J 2/473* (2013.01)

(58) Field of Classification Search
None
See application file for complete search history.

(56) References Cited

U.S. PATENT DOCUMENTS 5,721,579 A * 2/1998 Ogasawara et al. ..... 347/246
6,100,907 A * 8/2000 Uffel ..... 347/133
6,791,596 B2 9/2004 Nihei et al.
6,927,789 B2 8/2005 Ozasa et al.
6,933,957 B2 8/2005 Omori et al.
7,212,224 B2 5/2007 Nihei et al.
7,256,815 B2 8/2007 Suzuki et al.
7,271,824 B2 9/2007 Omori et al.
7,283,151 B2 10/2007 Nihei et al.
7,327,379 B2 2/2008 Nihei et al.
7,349,003 B2 * 3/2008 Shiota et al. ..... 347/236
2005/0089069 A1 4/2005 Ozasa et al.
2005/0146597 A1 * 7/2005 Seto ..... 347/246
2005/0219354 A1 10/2005 Omori et al.
2005/0243163 A1 11/2005 Ozasa et al.
2006/0209170 A1 9/2006 Nihei (Continued)

FOREIGN PATENT DOCUMENTS

JP 2-139260 5/1990
JP 8-290595 11/1996

(Continued)

OTHER PUBLICATIONS

Nov. 7, 2011 Japanese official action in connection with a counterpart Japanese patent application.

*Primary Examiner* — Uyen Chau N Le
*Assistant Examiner* — John M Bedtelyon
(74) *Attorney, Agent, or Firm* — Cooper & Dunham LLP

(57) ABSTRACT

A light source driving device which drives a plurality of light emitting parts provided in a light source to emit a plurality of light beams based on image information, includes a plurality of driving circuits configured to drive the plurality of light emitting parts. Each of the driving circuits includes a signal generation circuit that generates a modulation signal to control a light emitting intensity of the corresponding light emitting part based on the image information, a detection circuit that detects a light emitting status of the corresponding light emitting part; and a light emitting circuit that outputs a driving signal to the corresponding light emitting part to emit a light beam in accordance with the modulation signal and adjustment data obtained based on the light emitting status of at least one of the plurality of light emitting parts.

10 Claims, 11 Drawing Sheets

(56) References Cited

U.S. PATENT DOCUMENTS

| | | | | |
|---|---|---|---|---|
| 2006/0285186 | A1 | 12/2006 | Ishida et al. | |
| 2007/0030548 | A1 | 2/2007 | Nihei et al. | |
| 2007/0091163 | A1 | 4/2007 | Omori et al. | |
| 2007/0132828 | A1 | 6/2007 | Ishida et al. | |
| 2008/0079669 | A1* | 4/2008 | Jo et al. | 345/76 |
| 2008/0088893 | A1 | 4/2008 | Ishida et al. | |

FOREIGN PATENT DOCUMENTS

| | | |
|---|---|---|
| JP | 9-252166 | 9/1997 |
| JP | 9-260789 | 10/1997 |
| JP | 2001-117041 | 4/2001 |
| JP | 2001-272615 | 10/2001 |
| JP | 2002-86793 | 3/2002 |
| JP | 2006-202846 | 8/2006 |

* cited by examiner

LIGHT SOURCE DRIVING DEVICE, LIGHT SCANNING DEVICE AND IMAGE FORMING APPARATUS

PRIORITY CLAIM

This application claims priority from Japanese Patent Application No. 2007-136653, filed with the Japanese Patent Office on May 23, 2007, the contents of which are incorporated herein by reference in their entirety.

BACKGROUND OF THE INVENTION

1. Field of the Invention

The present invention relates to a light source driving device, a light scanning device and an image forming apparatus, more specifically, to a light source driving device that drives a light source, a light scanning device that scans a surface to be scanned and an image forming apparatus including the light scanning device.

2. Description of the Related Art

As an image forming apparatus that forms an image using Carlson's process, for example, an image forming apparatus in which a surface of a rotating photoconductive drum is scanned by light beams so that a latent image is formed on the surface of the rotating photoconductive drum is known. The image forming apparatus is configured to form an image by fixing a toner image obtained by visualizing the latent image to paper as a recording medium. In recent years, the image forming apparatus of this kind has often been used in simplified printing as an on demand printing system. Requests for images of higher density and image output of higher speed are further increasing.

Thereby, in order to simultaneously obtain an image of higher density and image output of higher speed, an image forming apparatus, which scans a photoconductive drum at once with a plurality of light beams using a multi-beam light source is proposed. An image forming apparatus of this kind deflects a bundle of light beams emitted from a surface emitting type laser having a plurality of light emitting parts so that it is possible to scan the photoconductive drum using a plurality of light beams at once.

A surface emitting type laser, for example, VCSEL (vertical cavity surface emitting laser) or the like is used in the image forming apparatus. A plurality of light emitting parts can easily be two-dimensionally arranged in one element, and as a result, the respective light emitting parts are influenced by heat generation thereof as well as heat generation from the peripheral light emitting parts and there is a problem in that light emitting properties change with time.

Thereby, an image forming apparatus including a mechanism to maintain the temperature of a light source at a constant or a light scanning device including a light source in which light emitting parts are disposed such that cross-talk does not become a problem is proposed (for example, see JP2006-202846A and JP2001-272615A). However, in these apparatuses or devices, a part such as a heat releasing plate or the like is required, and the degree of freedom of design of the optical system becomes small so that there is a problem in that the device gives rise to higher cost.

SUMMARY OF THE INVENTION

An object of the present invention is to provide a light source driving device able to maintain at a constant the output from each of the plurality of light emitting parts formed in the light source without giving rise to higher cost of the device.

To accomplish the above object, a light source driving device which drives a plurality of light emitting parts provided in a light source to emit a plurality of light beams based on image information, includes a plurality of driving circuits configured to drive the plurality of light emitting parts. Each of the driving circuits includes a signal generation circuit that generates a modulation signal to control a light emitting intensity of the corresponding light emitting part based on the image information, a detection circuit that detects a light emitting status of the corresponding light emitting part; and a light emitting circuit that outputs a driving signal to the corresponding light emitting part to emit a light beam in accordance with the modulation signal and adjustment data obtained based on the light emitting status of at least one of the plurality of light emitting parts.

DETAILED DESCRIPTION OF THE PREFERRED EMBODIMENTS

Preferred embodiments of the present invention will be explained in detail hereinafter with reference to the accompanying drawings.

Figure 2:
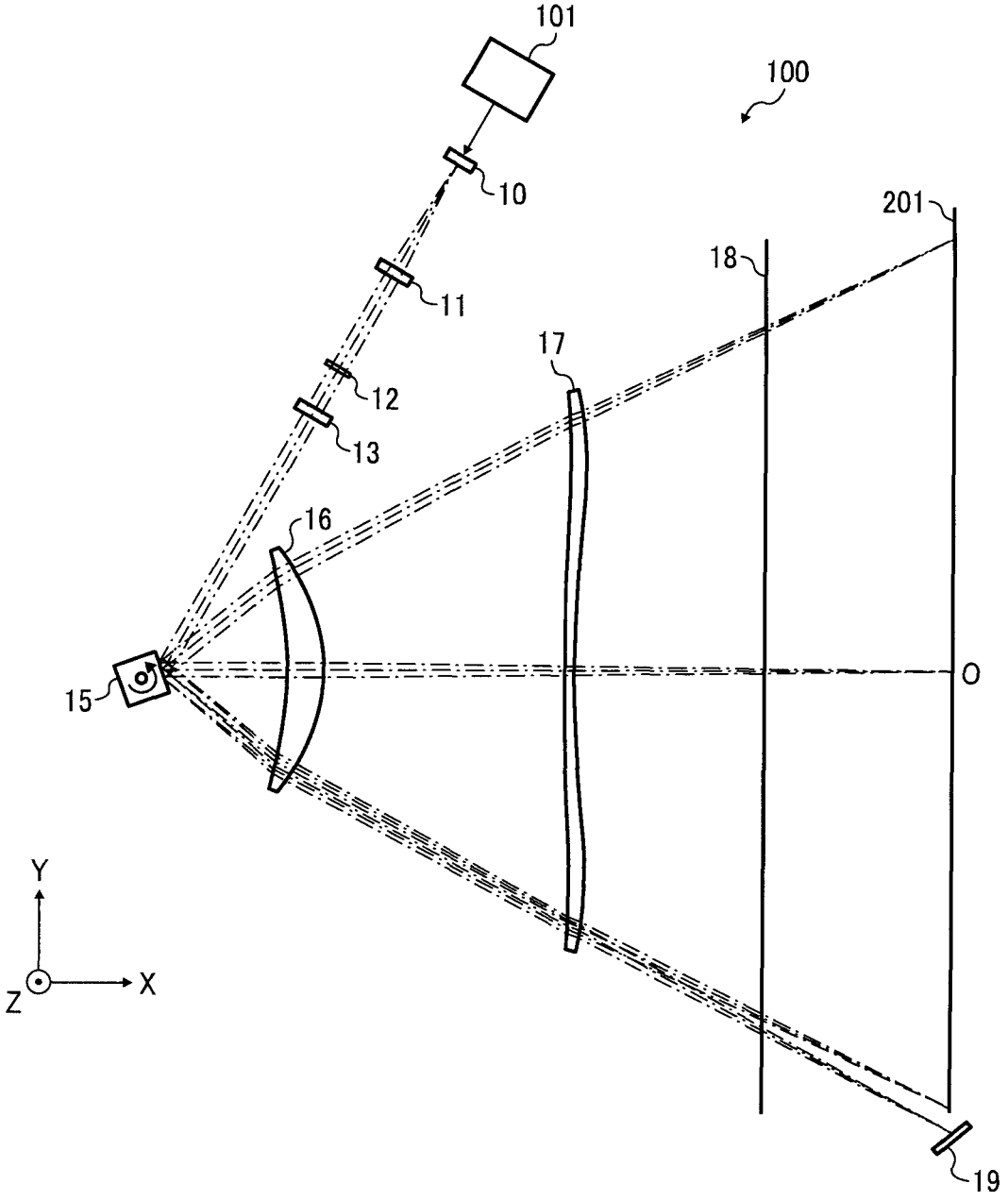
FIG. 2 is a layout diagram of a light scanning device.
Figure 5:
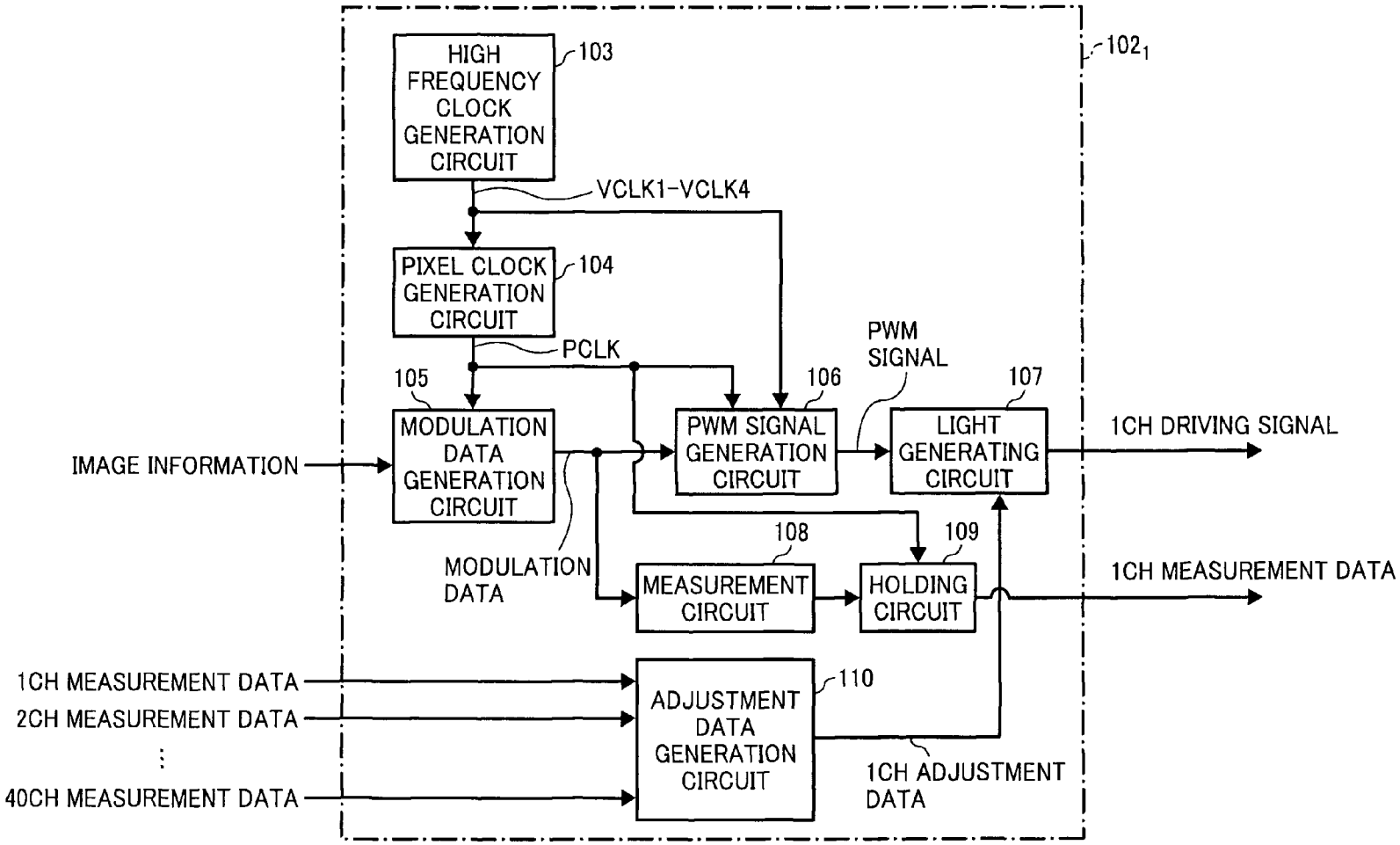
FIG. 5 is block diagram of a 1 ch driving circuit $\mathbf{102}_1$.

As shown in, for example, FIG. 2, a light source driving device 101 according to an embodiment of the present invention is configured to drive a plurality of light emitting parts VCSEL1 to VCSEL40 (see FIG. 3) provided in a light source 10 to emit a plurality of light beams based on image information. As shown in FIG. 5, the light source driving device 101 includes a plurality of driving circuits $\mathbf{102}_1$ to $\mathbf{102}_{40}$ to drive the plurality of light emitting parts $\mathrm{VCSEL}_1$ to $\mathrm{VCSEL}_{40}$, respectively. Each of the driving circuits $\mathbf{102}_1$ to $\mathbf{102}_{40}$ includes a signal generation circuit 105 such as a modulation data generation circuit that generates a modulation signal to control a light emitting intensity of the corresponding light emitting part VCSEL1 based on the image information, a detection circuit 108 including a measurement circuit that detects a light emitting status of the corresponding light emitting part VCSEL1, and a light emitting circuit 107 that outputs a driving signal to the corresponding light emitting part VCSEL1 to emit a light beam in accordance with the modulation signal and adjustment data obtained based on the light emitting status of at least one of the plurality of light emitting parts.

Figure 1:
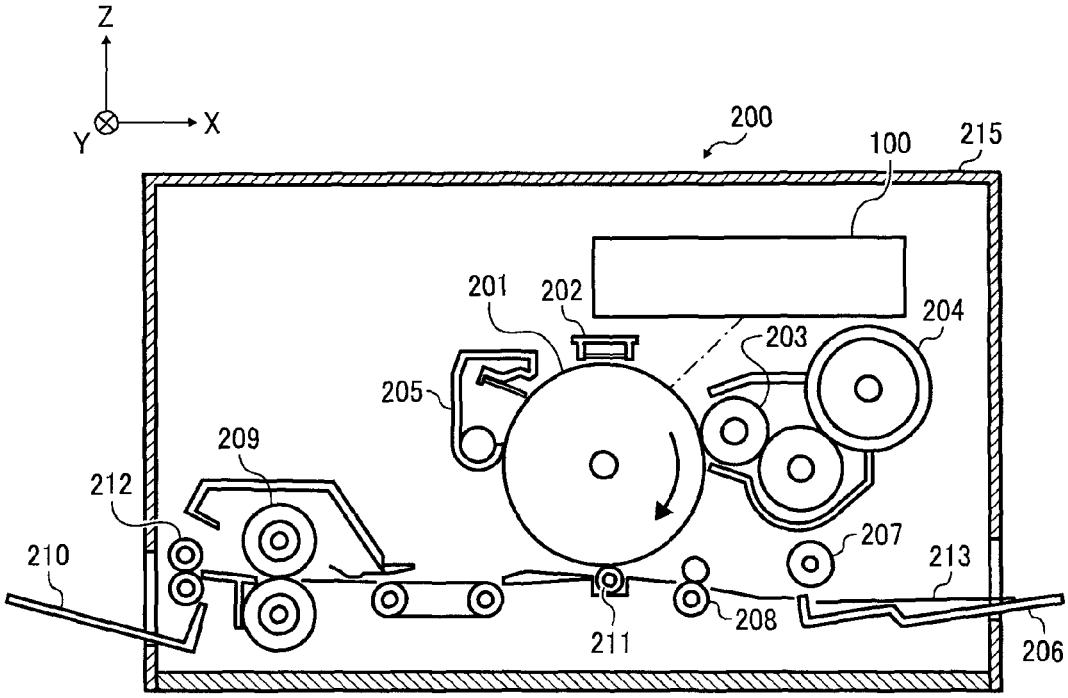
FIG. 1 is a diagram illustrating an approximate constitution of an image forming apparatus according to a first embodiment of the present invention.

The light source driving device 101 according to an embodiment can be used in a light scanning device of an image forming apparatus. A schematic structure of an image forming apparatus 200 including a light scanning device 100 using the light source device 101 according to one embodiment of the present invention is illustrated in FIG. 1.

The image forming apparatus 200 is, for example, a printer that prints an image based on image information by transferring a toner image to standard paper (sheet) using Carlson's process. The image forming apparatus 200, as illustrated in FIG. 1, includes a light scanning device 100, a photoconductive drum 201 as a photoreceptor on which a latent image is formed by the light scanning device 100, an image development device such as a development roller 203 that visualizes the latent image formed on the photoreceptor as a toner image a transfer device that fixes the toner image visualized by the image development device to the recording medium. The transfer device includes, for example, a transfer charger 211, a fixing roller 209.

The image forming apparatus 200 further includes an electrostatical charger 202, a toner cartridge 204, a cleaning case 205, a paper feeding tray 206, a paper feeding roller 207, a pair of resist rollers 208, a paper discharging roller 212, a paper discharging tray 210 and a housing 215 that holds the above.

The housing 215 is in an approximately rectangular solid shape and provided with an opening, which connects with the interior space in side walls of +X side and −X side.

The light scanning device 100 is disposed in an upside of an interior portion of the housing 220 and includes a light source 10 in which a plurality of light emitting parts VCSEL1 to VCSEL40 are provided and the light source driving device 101 according to Claim 1 to drive the light source 10. By scanning the surface to be scanned in a main scanning direction (the Y axis direction of FIG. 1) with a light beam modulated based on image information, an area (referred to as a write area hereinbelow) on the surface of the photoconductive drum 201 is scanned and the light scanning device 100 forms a latent image in the write area. The constitution of the light scanning device 100 is described later.

The photoconductive drum 201 is a cylindrical-shaped member and provided with a photoconductive layer on the surface thereof, which is conductive when light beams are illuminated to the surface of the photoconductive drum 201. The photoconductive drum 201 is disposed on a lower side of the light scanning device 100 in a longitudinal direction corresponding to a Y axis direction and rotated clock-wisely in FIG. 1 (the direction indicated by an arrow in FIG. 1) by a not illustrated rotating mechanism. Around the photoconductive drum 201, the electrostatical charger 202 is disposed in a 12 o'clock position (upside) of FIG. 1, the toner cartridge 204 is disposed in a 2 o'clock position, the transfer charger 211 is disposed in a 6 o'clock position and the cleaning case 205 is disposed in a 10 o'clock position.

The electrostatical charger 202 is disposed via a prescribed clearance against the surface of the photoconductive drum 201 and electrostatically charges the surface of the photoconductive drum 201 by a prescribed voltage.

The toner cartridge 204 includes a cartridge main body filled with a toner, the image development roller 203 electrostatically charged with voltages of a reverse polarity from the photoconductive drum 201 and so on. The toner cartridge 204 supplies toner filled in the cartridge main body to the surface of the photoconductive drum 201 via the image development roller 203.

The cleaning case 205 includes a rectangular-shaped cleaning blade having a longitudinal direction corresponding to the Y axis direction and is disposed so that an edge of the cleaning blade is in contact with the surface of the photoconductive drum 201. The toner absorbed to the surface of the photoconductive drum 201 is peeled off by the cleaning blade, accompanying the rotation of the photoconductive drum 201 and is re-collected to an internal part of the cleaning case 205.

The transfer charger 211 is disposed via a prescribed clearance against the surface of the photoconductive drum 201 and applied with voltages of a reverse polarity from the electrostatical charger 202.

The paper feeding tray 206 is disposed in a state where the edge of the +X side extends from the opening formed on the side walls of the +X side of the housing 215 and can hold a plurality of paper sheets 213 fed through an external part.

The paper feeding roller 207 takes out the paper sheets 213 sheet by sheet from the paper feeding tray 206 and leads them to a gap formed by the photoconductive drum 201 and the transfer charger 211 via the pair of resist rollers 208 constituted by a pair of rotating rollers.

The fixing roller 209 is constituted by a pair of rotating rollers and lets the paper sheets 213 become heated and pressurized and leads them to the paper discharging roller 212.

The paper discharging roller 212 is constituted by a pair of rotating rollers or the like and sequentially stacks the paper sheets 213 sent from the fixing roller 209 against the paper discharging tray 210 disposed in a state where the edge of the −X side extends from the opening formed on the side walls of the −X side of the housing 215.

Next, the constitution of the light scanning device 100 is described. FIG. 2 is a figure that illustrates an approximate constitution of the light scanning device 100. As shown in FIG. 2, the light scanning device 100 further includes a coupling lens 11, an aperture member 12, a line image forming lens 13 and a polygon mirror 15, which are sequentially arrayed on a straight line extending from the light source 10 as the starting point with an angle of approximately 70 degrees in relation to the X axis, a first scanning lens 16, a second scanning lens 17 and a reflection mirror 18, which are sequentially disposed on the +X side of the polygon mirror 15, and a light receiving element 19 which receives a light beam before the light beam enters the photoconductive drum 201.

Figure 3:
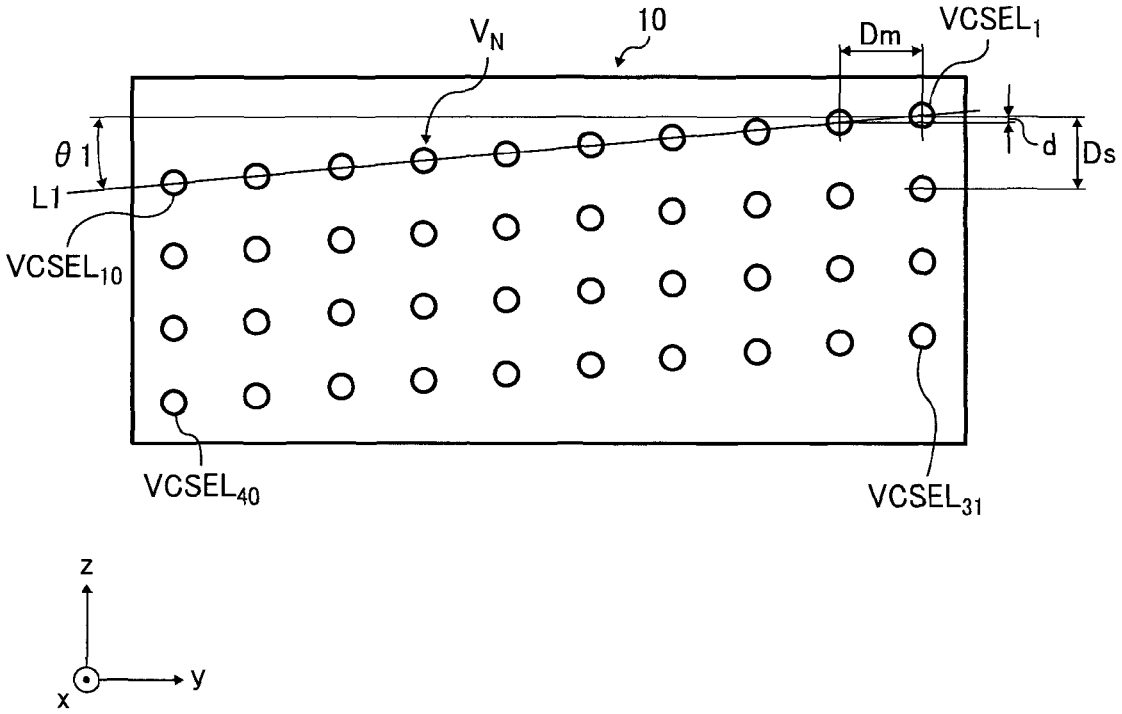
FIG. 3 is a diagram that illustrates a light source.

The light source 10 is, for example, a surface emitting type semiconductor laser array in which VCSELs as light emitting parts are disposed two-dimensionally. As shown in FIG. 3, on a light emitting surface of the light source 10 (a surface of the +x side of FIG. 3), 40 VCSELs $VCSEL_1$ to $VCSEL_{40}$ are disposed in a matrix of 4 rows in a direction parallel to a straight line L1 as a row direction which has an angle θ1 in relation to the Y axis, and 10 columns in a direction parallel to the Z axis as the column direction. As one example, each VCSEL has a near-field pattern having a diameter of 4 μm and emits light beams of a wavelength of 780 nm with a divergence angle in the main scanning direction and the sub-scanning direction of 7±1 degrees. In addition, as one example of the present embodiment, an interval Ds of the VCSELs in the row direction is 20 μm and an interval Dm of the VCSELs in the column direction is 30 μm.

Back to FIG. 2, the coupling lens 11 turns the light beams from the light source 10 into parallel light beams and couples the light beams at a focal position of the side of emission.

The aperture member 12 has an opening in a rectangular shape or ellipsoidal shape, and the center of the opening is disposed in a focal position of the coupling lens 11 or the vicinity thereof. The plurality of light beams emitted from the light source 10 are respectively turned into approximate parallel light by the coupling lens 11 and by passing through the opening of the aperture member 12, beam shapes are shaped into the desired shapes.

The line image forming lens 13 is a cylindrical lens having refractive power in the sub-scanning direction. The line image forming lens 13 forms an image of the respective light beams transmitting through the coupling lens 11 with regard to a sub-scanning direction in a reflective surface of the polygon mirror 15 or the vicinity thereof.

The polygon mirror 15 is a member of a quadrangular prism shape having an upper surface which is a square inscribed to a circle of a radius of 7 mm. Deflected surfaces of the polygon mirror 15 are respectively formed on the four side surfaces of the polygon mirror 15, rotated at a constant angular speed and spun around an axis parallel to the Z axis by a not illustrated rotating mechanism. The light beams entering the polygon mirror 15 are scanned in the Y axis direction.

The first scanning lens 16 has an image height which is proportional to an incidence angle of the light beam and an image plane of the light beams used to scan the surface at a given angular speed is moved at a constant velocity in relation to the Y axis by the polygon mirror 15.

The second scanning lens 17 is disposed so as to have a longitudinal direction corresponding to the Y axis direction, and forms on the surface of the photoconductive drum 201 an image of the entering light beams via the reflection mirror 18.

The light receiving element 19 is an element which outputs an electrical signal (photoelectric conversion signal) according to the intensity of the entering light beams. The light receiving element 19 is scanned by the polygon mirror 15, receives the light beams before entering the write area of the photoconductive drum 201 and outputs the signal according to the intensity of the received light beams.

Figure 4:
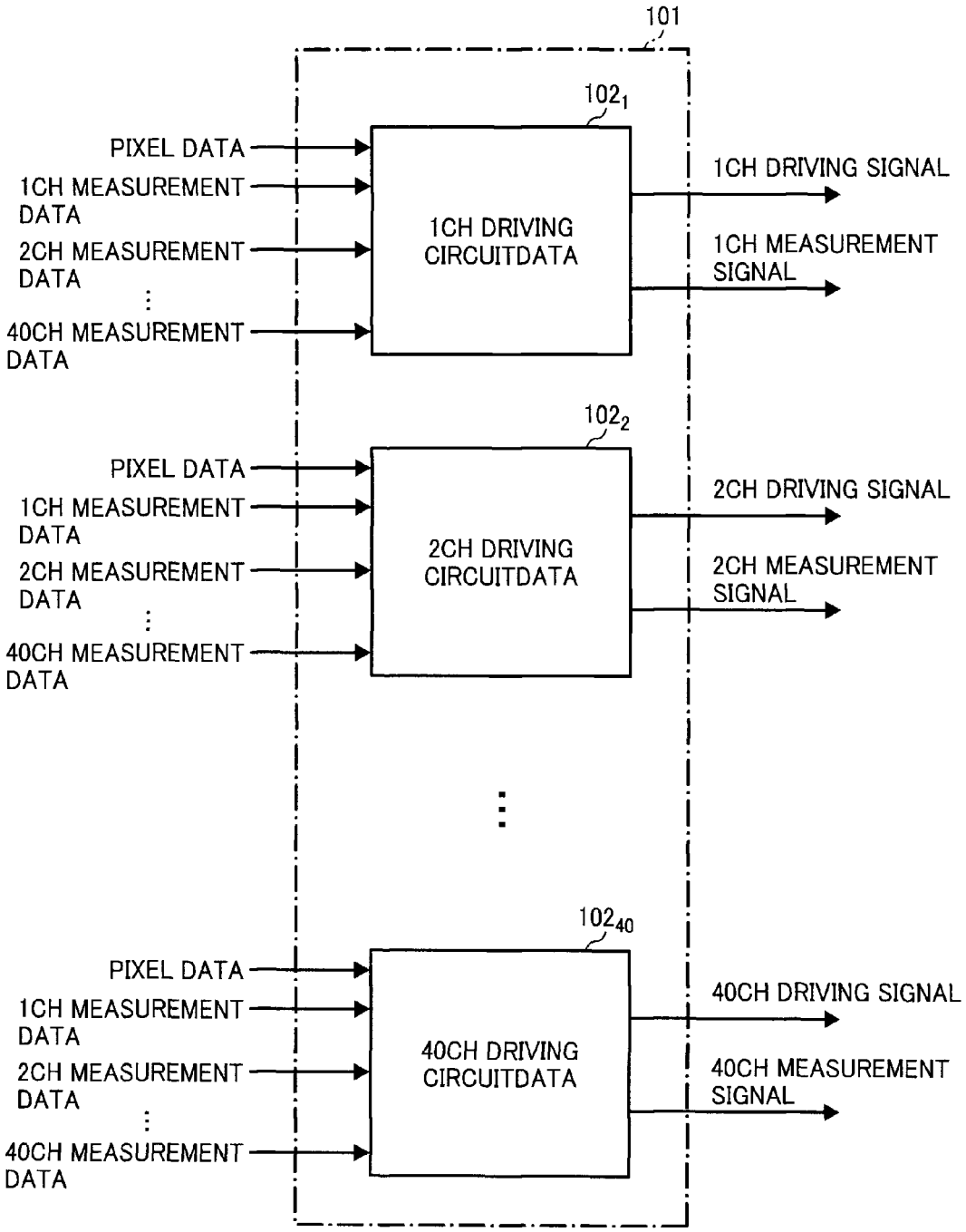
FIG. 4 is a block diagram of a light source driving device.

FIG. 4 is a block diagram of the light source driving device 101. As shown in FIG. 4, the light source driving device 101 includes 1 ch through 40 ch driving circuits $\mathbf{102}_1$ through $\mathbf{102}_{40}$ which drive the 40 VCSELs $VCSEL_1$ through $VCSEL_{40}$ formed in the light source 10, respectively.

Each of the 1 ch through 40 ch driving circuits $\mathbf{102}_1$ through $\mathbf{102}_{40}$ includes, as shown representatively by the 1 ch driving circuit $\mathbf{102}_1$ in FIG. 5 as an example, the modulation data generation circuit 105 that generates modulation data to control a light emitting intensity of the corresponding light emitting part VCSEL1 based on the image information, the measurement circuit 108 that detects a light emitting status of the corresponding light emitting part VCSEL1, and the light emitting circuit 107 that outputs a driving signal to the corresponding light emitting part VCSEL1 to emit a light beam in accordance with the modulation signal and an adjustment data obtained based on the light emitting status of at least one of the plurality of light emitting parts VCSEL1 to VCSEL40. The driving circuit $\mathbf{102}_1$ further includes a high frequency clock generation circuit 103, a pixel clock generation circuit 104, a PWM signal generation circuit 106, a holding circuit 109 and an adjustment data generation circuit 110. The adjustment data is determined by the light emitting status of the corresponding light emitting part as a target light emitting part and light emitting status of at least one light emitting part adjacent to the target light emitting part.

Figure 6:
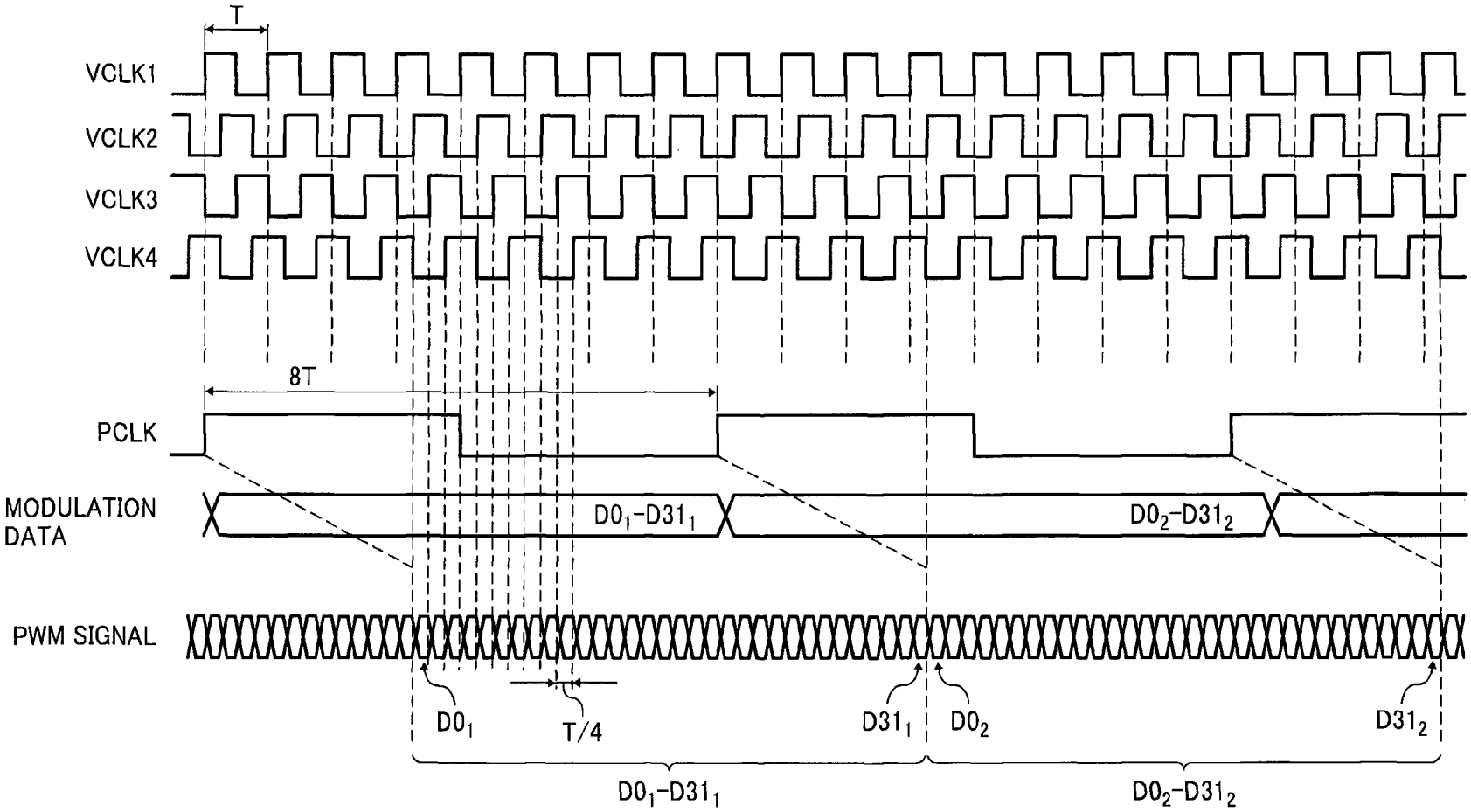
FIG. 6 is a diagram that illustrates output signals from each part that constitutes the 1 ch driving circuit $\mathbf{102}_1$.

The high frequency clock generation circuit 103, as shown in FIG. 6 as an example, outputs 4 high frequency clocks VCLK1 through VCLK4. The high frequency clock VCLK1 is in a rectangular shape and has a cycle of T, the high frequency clock VCLK2, the high frequency clock VCLK3 and the high frequency clock VCLK4 have delayed phases by T/4, 2 T/4, 3 T/4 in relation to the high frequency clock VCLK1, respectively.

The pixel clock generation circuit 104, as shown in FIG. 6, divides the frequency of the high frequency clock VCLK1 and outputs a pixel clock PCLK of a rectangular shape of a cycle of 8 T.

The modulation data generation circuit 105 modulates image information obtained from a higher-level device and outputs modulation data as a modulation signal in synchronization with the pixel clock PCLK. Specifically, image information contains pixel data of one pixel of an image formed on the recording media. The pixel data includes at least one bit, and, in this embodiment, is a 3 bit digital signal including 3 bits, which is supplied from the higher-level device. The modulation data generation circuit 105 has, for example, a look-up table 1 illustrated hereinbelow. The modulation data generation circuit 105 generates a modulation signal including modulation data of at least one bit, and in this embodiment, modulation data of 32 bits according to the supplied image information, in synchronization with the pixel clock PCLK.

TABLE 1

Look-up table 1

| pixel data | modulation data (D0 . . . D31) |
|---|---|
| 000 | 00000000000000000000000000000000 |
| 001 | 00000000000000000000000000001111 |
| 010 | 00000000000000000000000000111111 |
| 011 | 00000000000000000000001111111111 |
| 100 | 00000000000000000011111111111111 |
| 101 | 00000000000011111111111111111111 |
| 110 | 00000000111111111111111111111111 |
| 111 | 00001111111111111111111111111111 |

Figure 7:
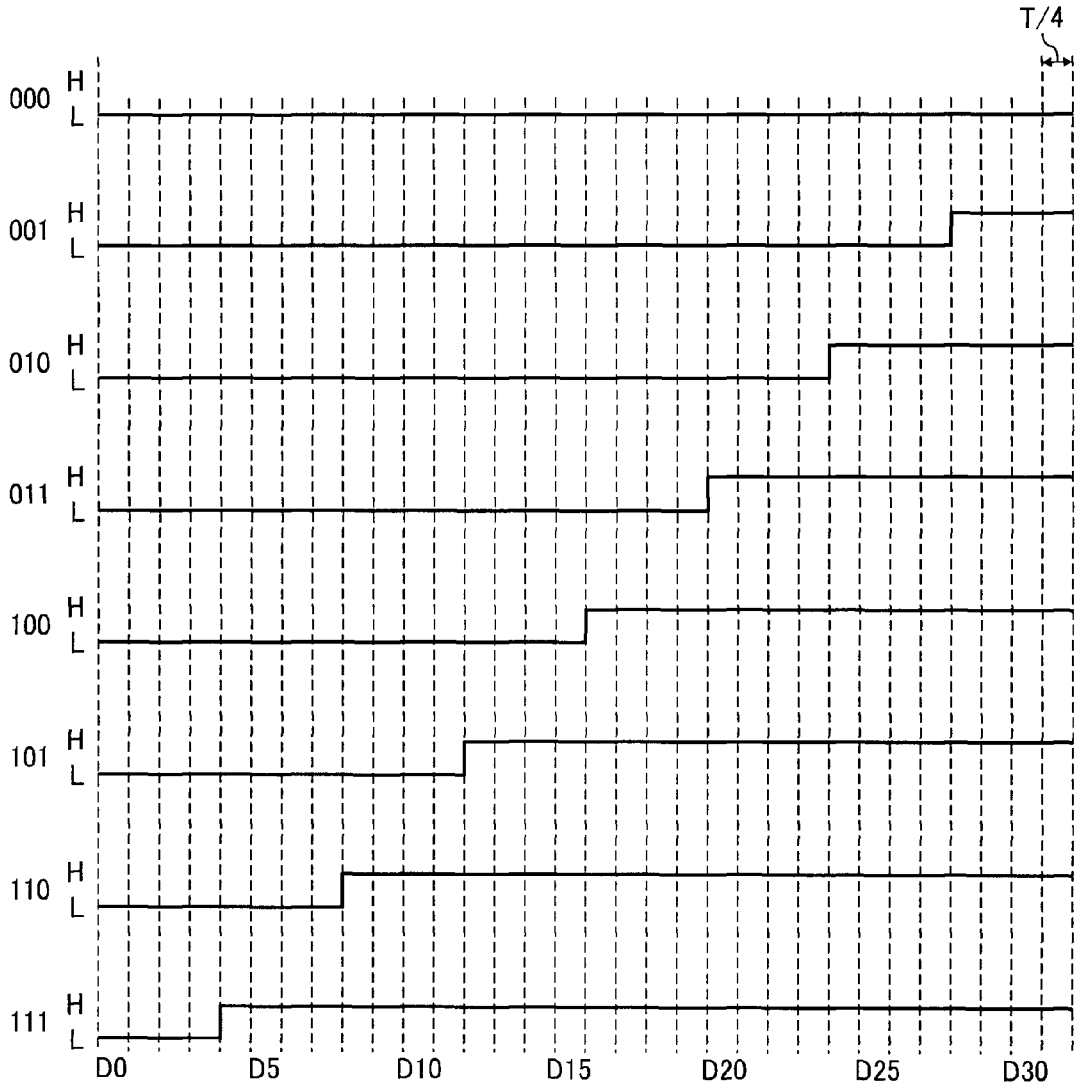
FIG. 7 is a diagram that illustrates an example of a PWM signal.

The PWM signal generation circuit 106 defines time T/4 as one unit, which is defined by the respective rising of each high frequency clock VCLK1 through VCLK4) and outputs a PWM signal binarized based on the modulation data. As an example, in FIG. 7, the PWM signals when image information is 000, 001, 010, 011, 100, 101, 110 and 111 are illustrated. As clearly found with reference to FIG. 7, the PWM signal is L level when the value of bit D0 through D31 is 0, and is H level when the value of bit D0 through D31 is 1. VCSEL of the light source 10 emits a light beam with a light intensity according to an intensity of the H level when the PWM signal is at H level.

The measurement circuit 108 counts a number of a value of "1" contained in the modulation data shown in Table 1 and outputs the counted value as the light emitting status of the corresponding light emitting part VCSEL1. For example, the counted value is 0 when the image information is 000. The counted value is 4 when the image information is 001. The counted value is 8 when the image information is 010. The counted value is 12 when the image information is 011. The counted value is 16 when the image information is 100. The counted value is 20 when the image information is 101. The counted value is 24 when the image information is 110. The counted value is 28 when the image information is 111. In this embodiment, the adjustment data is determined based on the counted value of the measurement circuit of at least one driving circuit.

Figure 8:
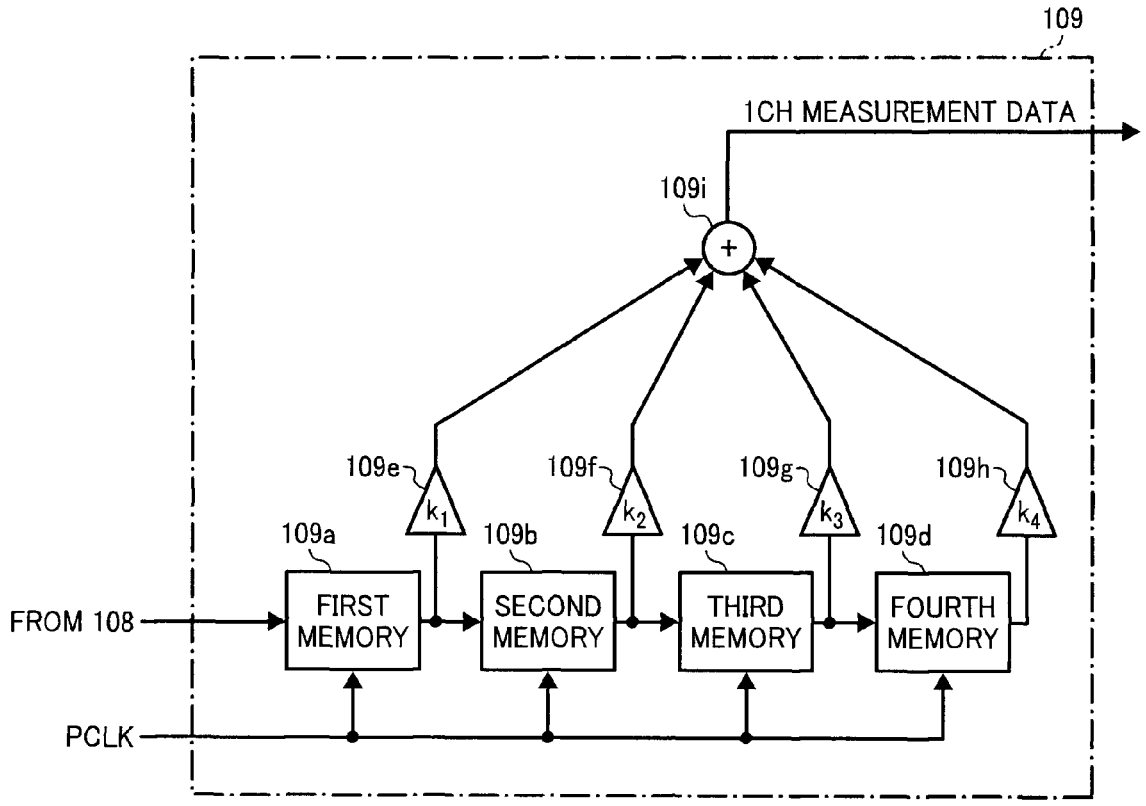
FIG. 8 is a block diagram of a holding circuit.

The holding circuit 109 is configured to sequentially hold the light emitting status of the corresponding light emitting part $VCSEL_1$ detected by the measurement circuit 108 and, as shown in FIG. 8, includes a first memory 109*a*, a second memory 109*b*, a third memory 109*c* and a fourth memory 109*d*, which are connected in series to each other, and four arithmetic units 109*e* through 109*h* which are connected respectively to an output side of each memory 109*a* through 109*d*. In this embodiment, the adjustment data may be determined based on the light emitting statuses held in the holding circuits 108 of the plurality of driving circuits, as described below.

The first memory 109*a* outputs the stored counted value to the second memory 109*b* and stores a counted value subsequently-outputted from the measurement circuit 108 in synchronization with the pixel clock PCLK. In the same manner, the second memory 109*b* outputs the stored counted value to the third memory 109*c* and stores the counted value outputted from the first memory 109*a* in synchronization with the pixel clock PCLK. In addition, the third memory 109*c* outputs the stored counted value to the fourth memory 109*d* and stores the counted value outputted from the second memory 109*b* in synchronization with the pixel clock PCLK. In addition, the fourth memory 109*d* outputs the stored counted value and stores the counted value outputted from the third memory 109*c* in synchronization with the pixel clock PCLK.

The adjustment data may be determined based on a result obtained by multiplying the light emitting statuses of the corresponding light emitting part held in the holding circuit by a coefficient which depends on a time when the light emitting status is detected by the detection circuit, respectively. That is, the counted values outputted from the first memory 109*a* through the fourth memory 109*d*, after being respectively multiplied by the given coefficients $k_1$ through $k_4$ with the arithmetic circuits 109*e* through 109*h*, are added to each other by an adder 109*i* and outputted as 1 ch measurement data from the 1 ch driving circuit $\mathbf{102}_1$.

Each coefficient $k_1$ through $k_4$, as an example, is determined based on the time when the number of the value "1" contained in the modulation data corresponding to the counted value stored in each of the first memory 109*a* through the fourth memory 109*d* is counted by the measurement circuit 108. Specifically, the counted value of 1 cycle before the pixel clock PCLK is stored in the first memory 109*a*. The counted value of 2 cycles before the pixel clock PCLK is stored in the second memory 109*b*. The counted value of 3 cycles before the pixel clock PCLK is stored in the third memory 109*c*. The counted value of 4 cycles before the pixel clock PCLK is stored in the fourth memory 109*d*. The counted values are proportional to the light emitting intensity of the corresponding VCSEL, that is, the counted values are proportional to a heating value of the corresponding VCSEL. Because the VCSEL is influenced by the heating value by the light emission at the closest time, the coefficient $k_1$ is set to be the largest of the coefficients, and $k_2$ through $k_4$. are set to become smaller in the order of the coefficients $k_2$, $k_3$, $k_4$. Thereby the 1 ch measurement data contains the light emitting status corresponding to the 4 closest pixel data of the corresponding VCSEL, that is, $VCSEL_1$ in a ratio depending on the time when the light is emitted from $VCSEL_1$.

As described above, in this embodiment, the light emitting status is detected or determined by the number of the value "1" contained in the modulation signal of the corresponding light emitting part.

Figure 9:
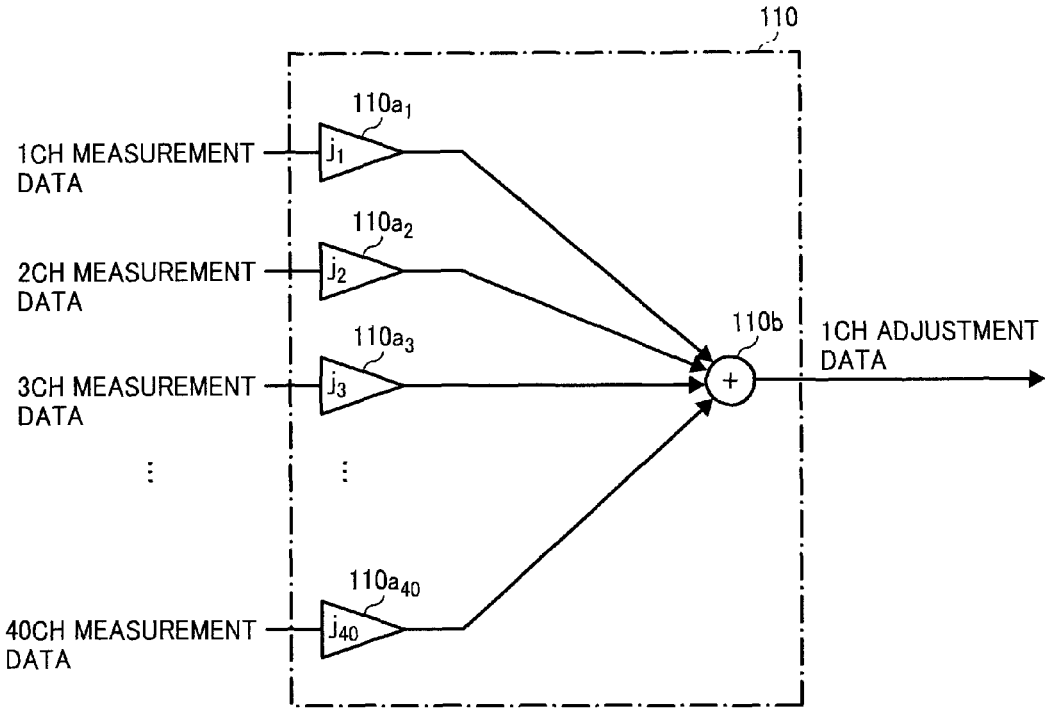
FIG. 9 is a block diagram of an adjustment data generation circuit.
Figure 10:
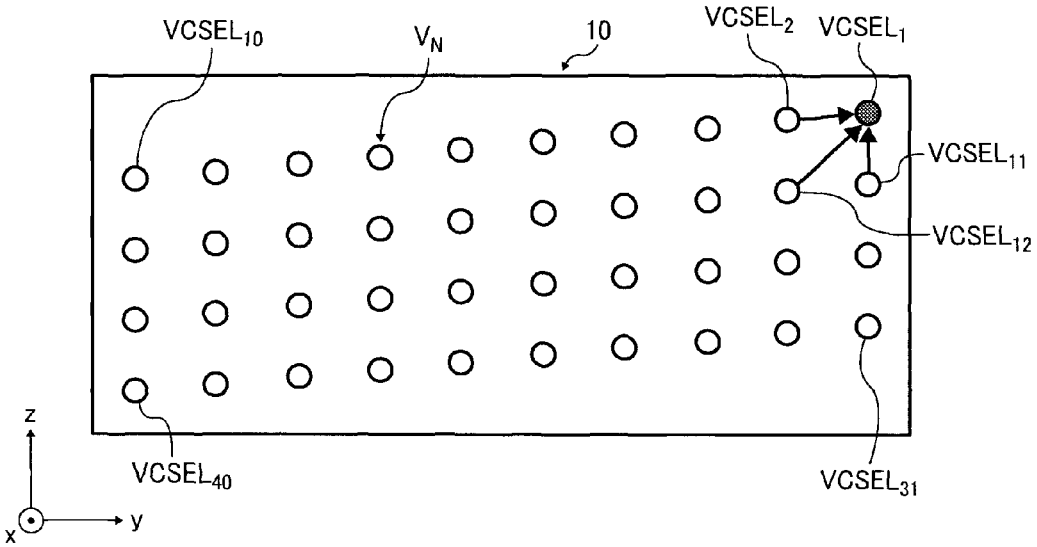
FIG. 10 is a diagram to explain a method to determine coefficients of an arithmetic circuit $\mathbf{110}a_1$ to $\mathbf{110}a_{40}$ of an adjustment data generation circuit.

In this embodiment, the adjustment data is determined by a result obtained by adding the light emitting statuses of the corresponding light emitting part as a target light emitting part and the at least one light emitting part disposed adjacent to the target light emitting part which are multiplied by coefficients depending on distances between the target light emitting part and the at least one light emitting part adjacent to the target light emitting part, respectively. The adjustment data generation circuit 110, as shown in FIG. 9, includes 40 arithmetic circuits $\mathbf{110}a_1$ through $\mathbf{110}a_{40}$ to which the 1 ch measurement data through the 40 ch measurement data outputted from the 1 ch driving circuit $\mathbf{102}_1$ through the 40 ch driving circuit $\mathbf{102}_{40}$ are respectively inputted. Then the 1 ch measurement data through the 40 ch measurement data, after being respectively multiplied by coefficients $j_1$ through $j_{40}$ in arithmetic circuits 110*a*, through $\mathbf{110}a_{40}$, are added by an adder 110*b* and outputted from the adjustment data generation circuit as a 1 ch adjustment data. As an example, the coefficients $j_1$ through $j_{40}$ are determined by arrangement position of the corresponding light emitting part VCSEL in the light source 10. For example, when the $VCSEL_1$ emits a light beam by the 1 ch driving circuit $\mathbf{102}_1$, the $VCSEL_1$ is most strongly influenced by heating derived from the light emission thereof ($VCSEL_1$) and as shown in FIG. 10, the light emission of $VCSEL_2$, $VCSEL_1$, $VCSEL_{12}$, which are disposed adjacent to the corresponding light emitting part $VCSEL_1$. Therefore, in the adjustment data generation circuit 110 of the 1 ch driving circuit $\mathbf{102}_1$, the coefficients $j_1$, $j_2$, $j_{11}$, $j_{12}$ corresponding to $VCSEL_1$, $VCSEL_2$, $VCSEL_{11}$, $VCSEL_{12}$ are made larger than the coefficient j corresponding to the other VCSELs. The other coefficients j are set to become gradually smaller the more distant from the corresponding light emitting part $VCSEL_1$. Thereby, the 1 ch adjustment data contains information with regard to the light emitting statuses of the 4 closest pixels of the respective $VCSEL_1$ through $VCSEL_{40}$ in a ratio depending on the light emitting time as well as information with regard to the arrangement position of each of the light emitting parts $VCSEL_1$ through $VCSEL_{40}$.

Back to FIG. 5, the light emitting circuit 107 augments the H level PWM signal outputted from the PWM signal generation circuit 106 according to the 1 ch adjustment data outputted from the adjustment data generation circuit 110 and outputs the augmented PWM signal as a 1 ch driving signal.

As illustrated in FIG. 4, each of the 2 ch driving circuit 1022 through a 40 ch driving circuit $\mathbf{102}_{40}$ other than the 1 ch driving circuit $\mathbf{102}_1$, has the same constitution as the 1 ch driving circuit $\mathbf{102}_1$ illustrated in FIG. 5. The adjustment data generation circuit 110 set on each of the respective 2 ch driving circuit 1022 through the 40 ch driving circuit $\mathbf{102}_{40}$ has coefficients for each arithmetic circuit $\mathbf{110}a_1$ through $\mathbf{110}a_{40}$. The coefficients, in the same way as the case of the 1 ch driving circuit $\mathbf{102}_1$, are set according to the positional relationship between the corresponding VCSEL and the VCSELs disposed adjacent to the corresponding VCSEL.

As described above, the light emitting circuit allows the corresponding light emitting part to emit the light beam based on a result obtained by multiplying the light emitting status of the corresponding light emitting part as a target light emitting part by each of coefficients corresponding to distances between the target light emitting part and other light emitting parts. Furthermore, the light emitting circuit allows the corresponding light emitting part to emit a light beam based on the light emitting statuses of the corresponding light emitting part as a target light emitting part and at least one light emitting part adjacent to the target light emitting part. As described above, the driving circuit includes a holding circuit that sequentially holds the light emitting status of the corresponding light emitting part detected by the detection circuit and the light emitting circuit drives the light emitting part based on the light emitting statuses held in the holding circuits of the plurality of driving circuits. The light emitting circuit allows the corresponding light emitting part to emit the light beam based on a result obtained by multiplying a measurement result held in the holding circuit by a coefficient determined based on measurement time.

Next, the operation of the image forming apparatus 200 constituted as above is described. When the image forming apparatus 200 receives image information from the higher level device, the light source driving device 101 of the light scanning device 100 selects for example, any of the VCSELs disposed in the first row of the VCSELs formed in the light source 10 and allows the VCSEL selected to emit light beam from the light source 10.

The light beams from the light source 10, after passing through the coupling lens 11 and the aperture member 12, are collected in the deflected surface of the polygon mirror 15 or the vicinity thereof by the line image forming lens 13. The light beams are then scanned in the Y axis direction by being deflected by the rotating polygon mirror 15. The scanned light beams are first received by the light receiving element 19 via the first scanning lens 16 and the second scanning lens 17 before the light beams enter the write area on the surface of the photoconductive drum 201.

The light source driving device 101, by monitoring a synchronization signal outputted from the light receiving element 19, detects that the light beams from the light source 10 enter the light receiving element 19, after the lapse of a given delay time from the detection, based on image information, the 1 ch driving signal through a 40 ch driving signal outputted from the 1 ch driving circuit $\mathbf{102}_1$ through the 40 ch driving circuit $\mathbf{102}_{40}$ are supplied respectively to the 40 $VCSEL_1$ through $VCSEL_{40}$ formed in the light source 10. Thereby the write area of the photoconductive drum 201 is scanned by 40 strings of light beams emitted respectively from $VCSEL_1$ through $VCSEL_{40}$.

On the other hand, the surface of the photoconductive drum 201 is charged with a predetermined voltage by the electrostatical charger 202 so that electrical charges are distributed in a constant electrical charge density. When the photoconductive drum 201 is scanned by light beams deflected by the polygon mirror 15, a carrier (electrical charge) is generated in the photosensitive layer of a part where light beams are irradiated and charge transfer occurs in the part, leading to a weakening of electrical potential. Therefore, the photoconductive drum 201 rotating in the direction of an arrow of FIG. 1, is scanned by light beams modulated based on image information so that an electrostatic latent image defined by the distribution of electrical charges is formed on the surface.

When the electrostatic latent image is formed on the surface of the photoconductive drum 201, by an image development roller of the toner cartridge 204, a toner is supplied to the surface of the photoconductive drum 201. Herewith, the image development roller of the toner cartridge 204 is electrically charged by voltages of a reverse polarity to the photoconductive drum 201 so that a toner adherent to the image development roller is electrically charged with the same polarity as the photoconductive drum 201. Therefore, the toner is not adhered to the part on the surface of the photoconductive drum 201 where electrical charges are distributed, but only adherent to the part scanned so that a toner image obtained by visualizing the electrostatic latent image is formed on the surface of the photoconductive drum 201. The toner image is adhered to a paper sheet 213 by a transfer charger 211, then fixed by a fixing roller 209 so that an image is formed on the paper. In such a way, the paper sheet 213 where an image is formed, is discharged by the paper discharging roller 212 and sequentially stacked to a paper discharging tray 210.

As described above, by a light scanning device 100 according to the present embodiment, the 1 ch driving circuit $\mathbf{102}_1$ through the 40 ch driving circuit $\mathbf{102}_{40}$ disposed in the light source driving device 101 are respectively inputted with, as shown in FIG. 4, image information and the 1 ch measurement data through the 40 ch measurement data. Based on these 1 ch measurement data through the 40 ch measurement data, 1 ch adjustment data through 40 ch adjustment data are respectively generated.

The 1 ch adjustment data through the 40 ch adjustment data generated as such contain a portion of 4 cycles of pixel clock PCLK, that is, information with regard to the light emitting statuses of a portion of the 4 closest pixels of the respective $VCSEL_1$ through $VCSEL_{40}$ in a ratio dependent on the light emitting time as well as information with regard to the arrangement position of the respective $VCSEL_1$ through $VCSEL_{40}$.

Therefore, based on the 1 ch adjustment data through the 40 ch adjustment data, the H level of the PWM signal which allows $VCSEL_1$ through $VCSEL_{40}$ to emit light is uplifted to be supplied to the light source 10 as the 1 ch driving signal through the 40 ch driving signal. Thereby, the weakening of the light emitting intensity because of the heat generation by the light emission of the VCSEL itself and the light emission of the VCSEL in the periphery is complemented and it is possible for the $VCSEL_1$ through the $VCSEL_{40}$ to respectively emit light at a constant intensity. In addition, a mechanism for cooling off the light source 10 is not required and it is possible to use a general purpose light source so that a higher cost device is not required.

In addition, in a light scanning device 100 according to the present embodiment, a plurality of light beams maintained at constant intensity are emitted from the light source so that it is possible to scan a surface to be scanned with high precision.

In addition, in an image forming apparatus 200 according to the present embodiment, scanning is performed by a plurality of light beams without any variation in beam intensity so that it is possible to form a high definition image without density unevenness or the like.

In the present embodiment, the number of a value "1" contained in the modulation data is set to be counted by the measurement circuit 108, but the present invention is not limited thereto, that is, the measurement circuit may have a table of light emitting status corresponding to the image information to detect the light emitting status of the corresponding light emitting part based on the image information with reference to the table.

Figure 11:
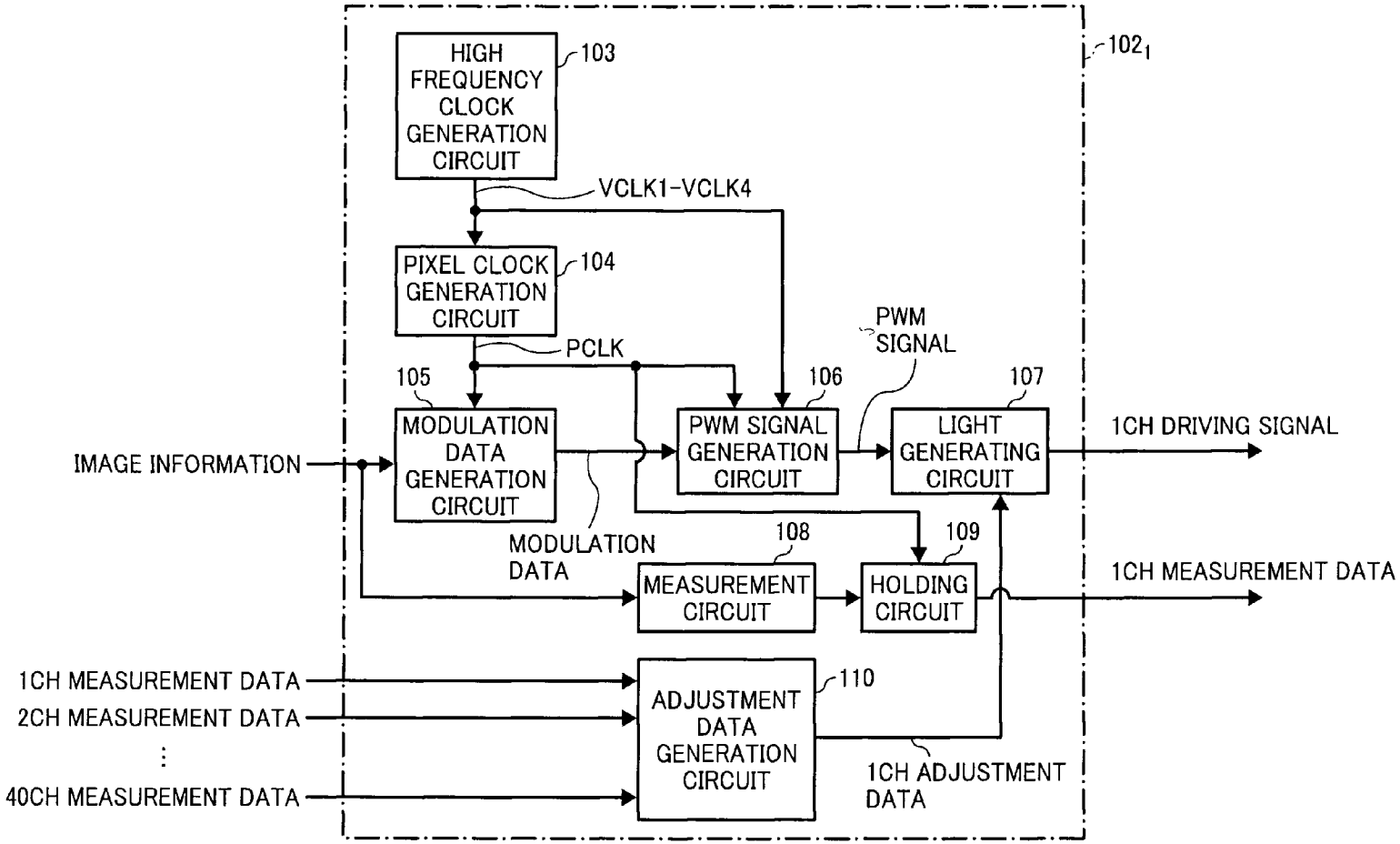
FIG. 11 is a block diagram of a 1 ch driving device $\mathbf{102}_1$ of a modified example.

The table is illustrated as look-up Table 2 as an example hereinbelow, and as shown in FIG. 11 as one example, by directly inputting the image information to the measurement circuit 108, the counted value corresponding to the image information can be outputted.

TABLE 2

Look-up table 2

| pixel data | counted value |
|---|---|
| 000 | 0 |
| 001 | 4 |
| 010 | 8 |
| 011 | 12 |
| 100 | 16 |
| 101 | 20 |
| 110 | 24 |
| 111 | 28 |

In addition, in the present embodiment, a surface emitting type light source 10 having a plurality of VCSEL as the light source is used, but as it is not limited to this, an LD laser array or the like can be used as the light source.

In addition, in the present embodiment, the number of a value "1" contained in the modulation data is counted by the measurement circuit 108, but as it is not limited to this, the number of a value "1" contained in the PWM signal can also be counted.

In addition, in the present embodiment, 4 memories 109*a* through 109*d* are set in the holding circuit 109 to store the light emitting statuses corresponding to the closest 4 pixels, but as they are not limited to this, the number of memories can be more than 4 and can be less depending on the degree of fluctuation of the light emitting properties.

In addition, in the present embodiment, a 1 ch adjustment signal through a 40 ch adjustment signal are respectively generated based on a 1 ch measurement signal through a 40 ch measurement signal, but as they are not limited to this, for example, in the case where only heat generation from adjacent VCSEL becomes the problem, the 1 ch adjustment signal through the 40 ch adjustment signal can be respectively generated based on only measurement signals relating to the VCSEL adjacent to the VCSEL as the light emitting target.

In addition, in the above embodiment, a case is described in which the light scanning device 100 is used as a single color image forming apparatus 200 (printer). But the image forming apparatus, as one example shown in FIG. 12, can correspond to color images and be a tandem color device including a plurality of photoconductive drums. The tandem color device shown in FIG. 12 includes a photoconductive drum K1 for black (K), a charger K2, an image development device K4, a cleaning device K5 and a charge device K6 for transfer, a photoconductive drum C1 for cyan (C), a charger C2, an image development device C4, a cleaning device C5 and a charge device C6 for transfer, a photoconductive drum M1 for magenta (M), a charger M2, an image development device M4, a cleaning device M5 and a charge device M6 for transfer, a photoconductive drum Y1 for yellow (Y), a charger Y2, an image development device Y4, a cleaning device Y5 and a charge device Y6 for transfer, a light scanning device 900, a transfer belt 902 and a fixing device 901 and so on.

In this case, the light scanning device 900 includes the light source driving device 101, and each of the plurality of light emitting parts of for example, the light source 10, are divided into for black, for cyan, for magenta and for yellow. Then light beams from each light emitting part for black are irradiated by the photoconductive drum K1, light beams from each light emitting part for cyan are irradiated by the photoconductive drum C1, light beams from each light emitting part for magenta are irradiated by the photoconductive drum M1 and light beams from each light emitting part for yellow are irradiated by the photoconductive drum Y1. In addition, the light scanning device 900 can include the individual light source 10 on a color to color basis. And each color may include the light scanning device 900.

Figure 12:
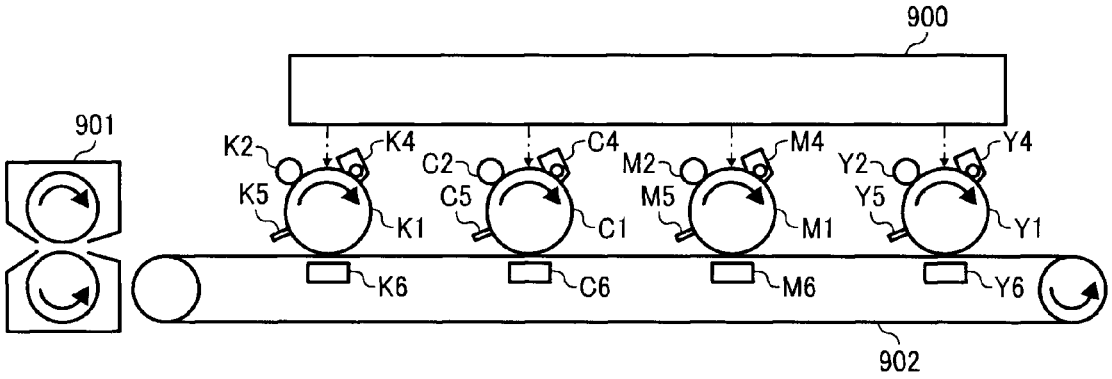
FIG. 12 is a diagram that illustrates an approximate constitution of a multi-color image forming apparatus.

Each photoconductive drum rotates in the direction of an arrow in FIG. 12, and a charger, an image development device, a charge device for transfer and a cleaning device are disposed in the sequence of rotation. Each charger uniformly charges the surface of the corresponding photoconductive drum. Beams are irradiated by the light scanning device 900 to the surface of the photoconductive drum charged by the charger so that an electrostatic latent image is formed on the photoconductive drum. Then a toner image is formed on the surface of the photoconductive drum by a corresponding image development device. Furthermore, by a corresponding charge device for transfer, the toner image of each color is transferred to recording paper and finally an image is fixed to the recording paper by a fixing device 901.

In addition, in each embodiment described above, the case is described wherein the light scanning device of the present invention is used for a printer, but the light scanning device is also suited to image forming apparatuses other than the printer, for example, a copier machine, a facsimile or a hybrid machine.

According to another aspect of the present invention, there is provided a light scanning device able to scan a surface to be scanned with high precision without giving rise to a higher cost of the device.

According to still another aspect of the present invention, there is provided an image forming apparatus able to form an image with high precision without giving rise to a higher cost of the device.

Accordingly, the light emitting part of the light source emits light based on the light emitting situation of each of the plurality of light emitting parts detected by the detection circuit and the modulation signal to control the light emitting intensity of the light emitting parts. Hereby, light emittance of each of the light emitting parts is performed by taking into account the light emitting situation of each of the light emitting parts formed in the light source, and changes in light emitting properties because of the self-heating of the light emitting parts, and the heat interference from the light emitting parts disposed in the periphery can be complemented so that it is possible to maintain at a constant the output from each of the light emitting parts formed in the light source. In addition, the constitution does not require a mechanism to maintain at a constant the temperature of the light source so that the degree of freedom of layout of the light emitting parts is not inhibited and it is possible to avoid a device of higher cost.

According to still another aspect of the present invention, there is provided a light scanning device which scans a surface to be scanned by light beams. The light scanning device includes a light source in which a plurality of light emitting parts are formed; and a light source driving device of the present invention.

Accordingly, the light scanning device includes a light source driving device of the present invention. Therefore, an intensity differential between light beams because of the heat generation of the light source becomes small so that it is possible to scan a surface to be scanned with high precision. In addition, it is possible to prevent a device of higher cost.

According to still another aspect of the present invention, there is provided an image forming apparatus which forms an image by fixing a toner image formed based on a latent image obtained from image information to a recording media. The image forming apparatus includes a light scanning device of the present invention; a photoreceptor in which a latent image is formed by the light scanning device; an image development device which visualizes the latent image formed on a surface of the photoreceptor; and a transfer device which fixes the toner image visualized by the image development device to the recording media.

Accordingly, the image forming apparatus includes a light scanning device of the present invention. Therefore, it is possible to scan the photoreceptor with high precision. As a result, it is possible to form an image with high precision. In addition, it is possible to avoid a device of higher cost.

Although the preferred embodiments of the present invention have been described, it should be understood that the present invention is not limited to these embodiments, and various changes and modifications can be made to the embodiments.

What is claimed is:

1. A light source driving device which drives a plurality of light emitting parts provided in a light source to emit a plurality of light beams based on image information, comprising a plurality of driving circuits configured to drive the plurality of light emitting parts, each driving circuit of the plurality of driving circuits comprising:

a signal generation circuit that generates a modulation signal to control a light emitting intensity of the corresponding light emitting part based on the image information;

a detection circuit that detects a light emitting status of the corresponding light emitting part;

a light emitting circuit that outputs a driving signal to the corresponding light emitting part to emit a light beam in accordance with the modulation signal and adjustment data obtained based on the light emitting status of at least one of the plurality of light emitting parts; and a holding circuit comprising plural memory units to store plural light emitting statuses of the light emitting part, in accordance with a clock signal, and output measurement data, wherein the plural light emitting statuses are detected and output by the detection circuit sequentially, and the holding circuit registers synchronously in accordance with the clock signal the sequentially obtained light emitting statuses detected by the detection circuit from a single light emitting part amongst the plurality of light emitting parts such that the holding circuit holds, at one instant in time, the plural light emitting statuses of the single light emitting part detected at different points in time, wherein the adjustment data for each light emitting part is determined based on the measurement data, generated from the light emitting statuses held in the holding circuit, of two or more of the plurality of light emitting parts.

2. A light source driving device according to claim 1, wherein the adjustment data is determined by the light emitting status of the corresponding light emitting part as a target light emitting part and light emitting status of at least one light emitting part adjacent to the target light emitting part.

3. A light source driving device according to claim 1, wherein the modulation signal is a digital signal, the detection circuit counts and detects a number of a value "1" contained in the modulation signal, and the adjustment data is determined based on the counted value of the detection circuit of at least one driving circuit.

4. A light source driving device according to claim 1, wherein the detection circuit has a table of light emitting status corresponding to the image information, and detects the light emitting status of the corresponding light emitting part based on the image information with reference to the table.

5. A light source driving device according to claim 1, wherein the adjustment data is determined by a result obtained by the light emitting statuses of the corresponding light emitting part as a target light emitting part and the at least one light emitting part disposed adjacent to the target light emitting part which are multiplied by coefficients depending on distances between the target light emitting part and the at least one light emitting part adjacent to the target light emitting part, respectively.

6. A light source driving device according to claim 1, wherein the adjustment data is determined based on a result obtained by multiplying the light emitting statuses of the corresponding light emitting part held in the holding circuit by coefficients which depend on a time when the light emitting status is detected by the detection circuit, respectively.

7. A light scanning device that scans a surface to be scanned by a light beam, comprising:

a light source in which a plurality of light emitting parts are provided; and a light source driving device according to claim 1 to drive the light source.

8. A light scanning device according to claim 7, wherein the light source is a laser array.

9. A light scanning device according to claim 7, wherein the light source is a surface emitting type light source.

10. An image forming apparatus that forms an image based on image information on a recording medium, comprising:

a light scanning device according to claim 7;

a photoreceptor on which a latent image is formed by the light scanning device;

an image development device that visualizes the latent image formed on the photoreceptor as a toner image; and a transfer device that fixes the toner image visualized by the image development device to the recording medium.

* * * * *